US005553350A

United States Patent [19]

Chang

[11] Patent Number: 5,553,350

[45] Date of Patent: Sep. 10, 1996

[54] TELESCOPIC HANDLE WITH FREELY ADJUSTABLE LENGTH

[76] Inventor: Fu-Jung Chang, 8 Fl.-5, No. 191, Fu Hsing N. Rd., Taipei, Taiwan

[21] Appl. No.: 322,196

[22] Filed: Oct. 12, 1994

[51] Int. Cl.[6] ..... B25G 1/04

[52] U.S. Cl. ..... 16/115; 190/18 A

[58] Field of Search ..... 16/115, 111 R, 16/DIG. 38; 280/47.315, 47.371, 655, 655.1; 190/18 A, 104, 18 R, 39, 14, 15 R; 43/11, 12

[56] References Cited

U.S. PATENT DOCUMENTS

| | | | |
|---|---|---|---|
| 652,096 | 6/1900 | Dunn | 16/115 |
| 2,840,402 | 6/1958 | Hassel | 43/11 |
| 3,596,946 | 8/1971 | Burton | 16/115 |
| 5,291,976 | 3/1994 | Ku | 190/18 A |
| 5,335,759 | 8/1994 | Yeh | 190/18 A |
| 5,371,923 | 12/1994 | Chang | 16/115 |

*Primary Examiner*—Chuck Y. Mah

*Attorney, Agent, or Firm*—Merchant, Gould, Smith, Edell, Welter & Schmidt, P.A.

[57] ABSTRACT

A handle set includes two telescopic handles with freely adjustable length. Each of the telescopic handles includes a first tube, a second tube into which the first tube is telescopically insertable, a tubular anchor with an upper tip attached to a lower tip of the first tube, a lower portion defining a plurality of slits so that the lower portion of the tubular anchor can be expanded easily, a link insertable through the first tube, a plug attached to a lower tip of the link. The plug can be moved to an upper position by pulling the link for abutting the lower portion of the tubular anchor against the first tube for restraining the first tube relative to the second tube. The plug can be moved to a lower position by pushing the link for releasing the lower portion of the tubular anchor from the first tube for allowing the movement of the first tube in respect to the second tube. Each of two link-driving devices is connected between a grip and one of the telescopic handles. The links can be driven by means of the link-driving devices by pivoting the grip.

11 Claims, 4 Drawing Sheets

TELESCOPIC HANDLE WITH FREELY ADJUSTABLE LENGTH

BACKGROUND OF THE INVENTION

This invention relates to a telescopic handle with freely adjustable length.

There have been various trolleys for carrying luggage. Each of the trolleys includes two handles and a grip for connecting the handles with each other. A prior-art telescopic handle includes a first tube and a second tube. Each of the first tubes is telescopically insertable in one of the second tubes. The second tubes are attached to a base. A spring-biased latch is attached to each of the first tubes. Each of the second tubes defines a plurality of apertures. The spring-biased latch attached to each of the first tubes is receivable in one of the apertures defined in one of the second tubes for adjusting the length of the prior-art telescopic handles. Subtler adjusting of the prior-art telescopic handles is possible only if more apertures are defined in the second tubes, this, however, reduces the strength of the second tubes.

SUMMARY OF THE INVENTION

It is the primary objective of this invention to provide a handle set including two telescopic handles with freely adjustable length. Each of the telescopic handles includes a first tube, a second tube into which the first tube is telescopically insertable, a tubular anchor with an upper tip attached to a lower tip of the first tube, a lower portion defining a plurality of slits so that it can be expanded easily, a link insertable through the first tube, a plug attached to a lower tip of the link. The plug can be moved to an upper position by pulling the link for abutting the lower portion of the tubular anchor against the first tube for restraining the first tube relative to the second tube. The plug can be moved to a lower position by pushing the link for releasing the lower portion of the tubular anchor from the first tube for allowing the movement of the first tube in respect to the second tube. Each of two link-driving devices is connected between a grip and one of the telescopic handles. The links can be driven by means of the link-driving devices by pivoting the grip.

DETAILED DESCRIPTION OF THE PREFERRED EMBODIMENT

Figure 5:
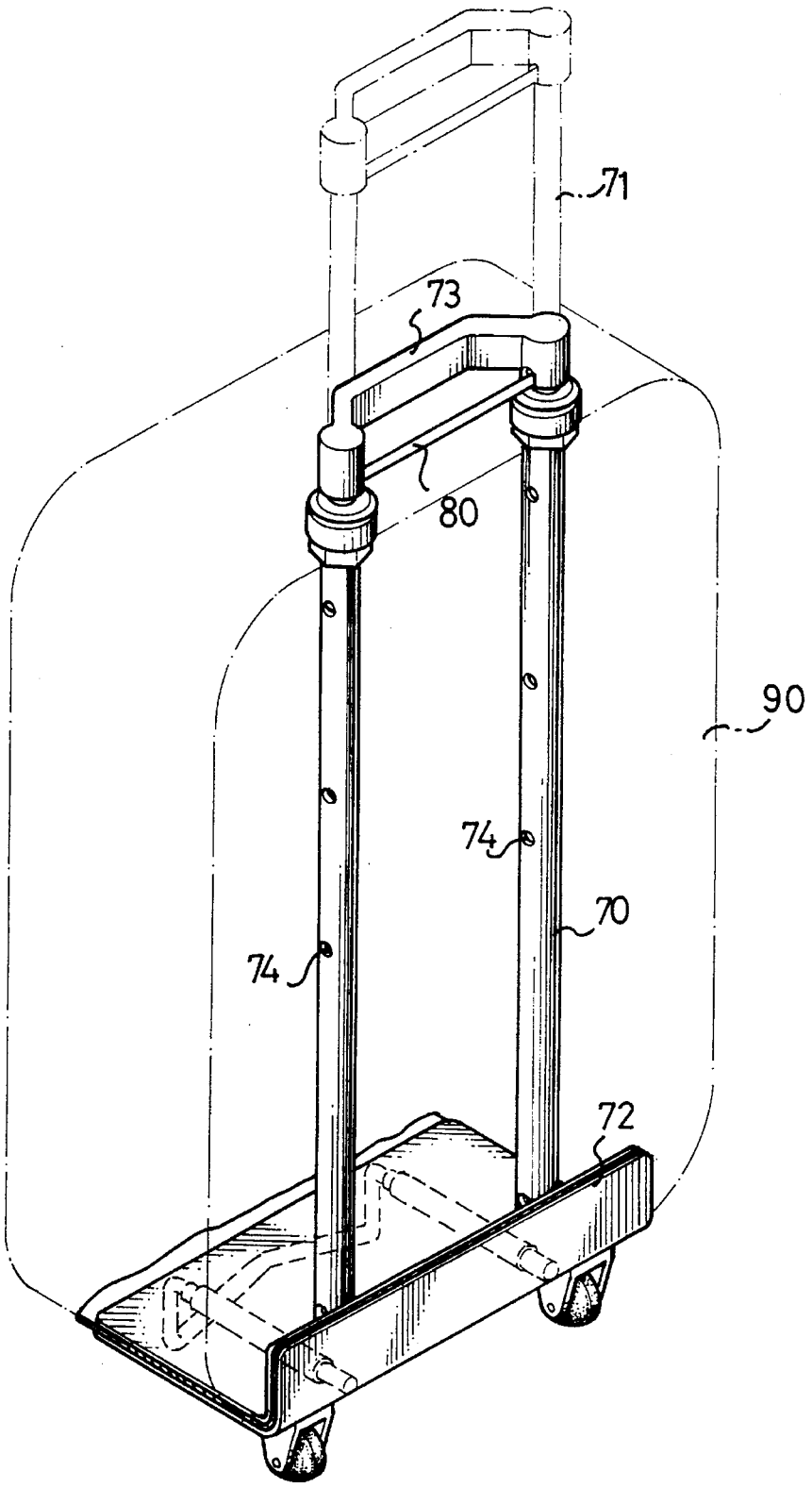
FIG. 5 PRIOR ART
FIG. 5 is a perspective view of a trolley incorporating two telescopic handles with adjustable length according to prior art.

A trolley incorporating two prior-art telescopic handles with adjustable length will be described referring to FIG. 5 before the preferred embodiment of this invention in order to show drawbacks of the prior-art telescopic handles.

A trolley includes two prior-art telescopic handles with adjustable length. The prior-art telescopic handles are connected with each other by means of a grip 73. Each of the prior-art telescopic handles includes a first tube 71 and a second tube 70. Each of the first tubes 71 is telescopically insertable in one of the second tubes 70. The second tubes 70 are attached to a base 72. A spring-biased latch (not shown) is attached to each of the first tubes 71. Each of the second tubes 70 defines a plurality of apertures 74. The spring-biased latch attached to each of the first tubes 71 is receivable in one of the apertures defined in one of the second tubes 70 for adjusting the length of the prior-art telescopic handles. Subtler adjusting of the prior-art telescopic handles is possible only if more apertures are defined in the second tubes, this, however, reduces the strength of the second tubes 70.

The preferred embodiment of a telescopic handle according to this invention will be described referring to FIGS. 1–4 in order to show the advantage of this invention over prior art.

Figure 1:
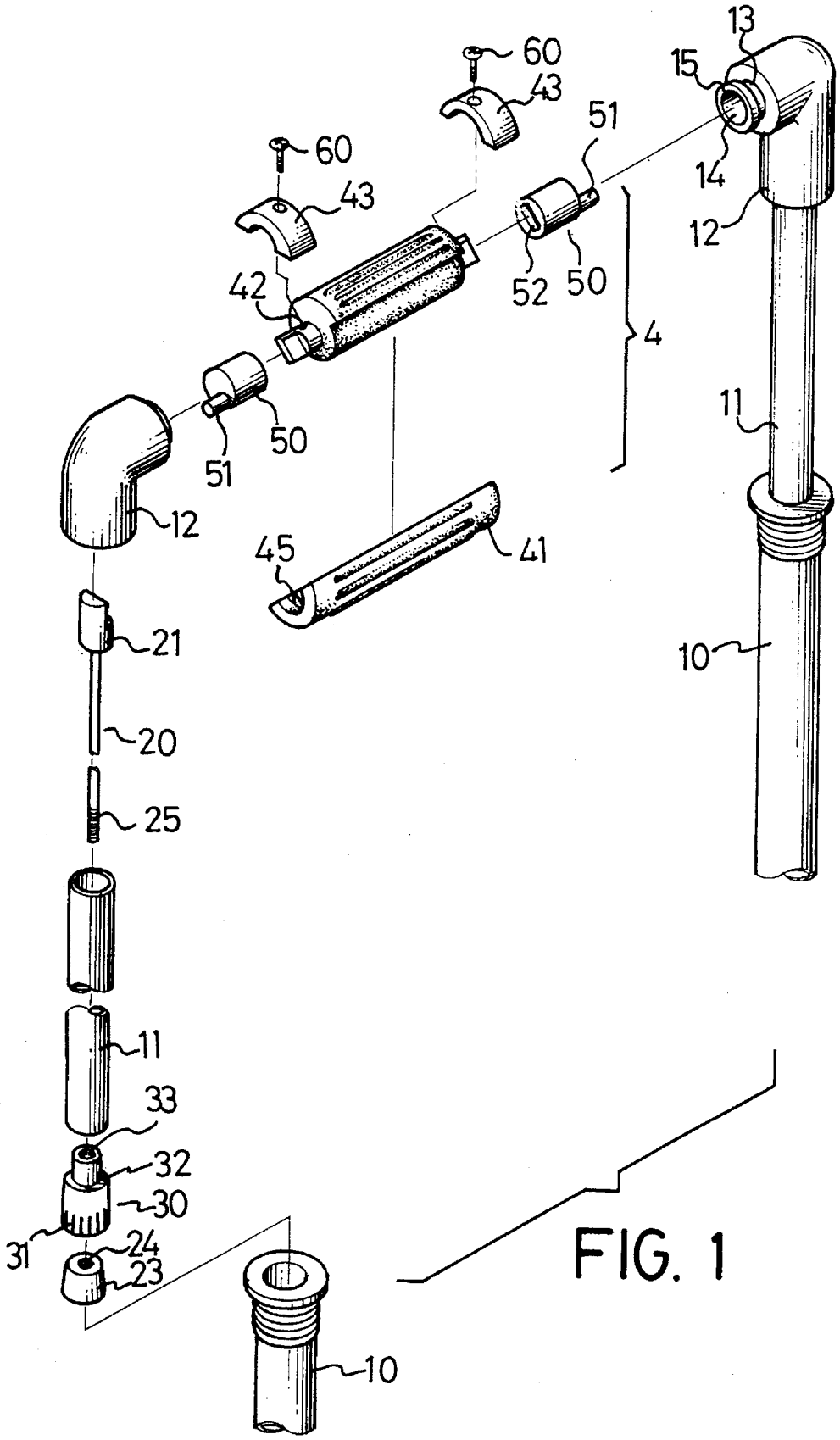
FIG. 1 is an exploded view of the preferred embodiment of a telescopic handle with freely adjustable length according to this invention.

FIG. 1 shows two telescopic handles (not numbered) and a grip 4 connected between the telescopic handles. Each of the telescopic handles includes a first tube 11 and a second tube 10 wherein the first tube 11 is telescopically receivable in the second tube 10. Detailed description will be given to only the telescopic handle shown on the left hand side for clearness and convenience thereof.

A tubular anchor 30 includes at a lower portion defining a plurality of slits 31 so that the lower portion of the tubular anchor 30 can be expanded easily. The tubular anchor 30 includes a tubular neck 33 projecting axially from an upper terminal portion thereof. The diameter of the tubular anchor 30 is greater than that of the tubular neck 33. The upper terminal portion of the tubular anchor 30 is formed as an annular shoulder 32. The tubular neck 33 is receivable in a lower tip of the first tube 11 until the lower tip of the first tube 11 abuts against the annular shoulder 32. The tubular anchor 30 is thus attached to the first tube 11.

A link 20 includes a thread 25 formed on a lower tip and a head 21 formed on an upper tip.

A tubular plug 23 is formed as a frustum of a cone. The tubular plug 23 includes a thread 24 formed on an internal surface. The thread 25 is engageable with the thread 24 for attaching the tubular plug 23 to the link 20.

Figure 3:
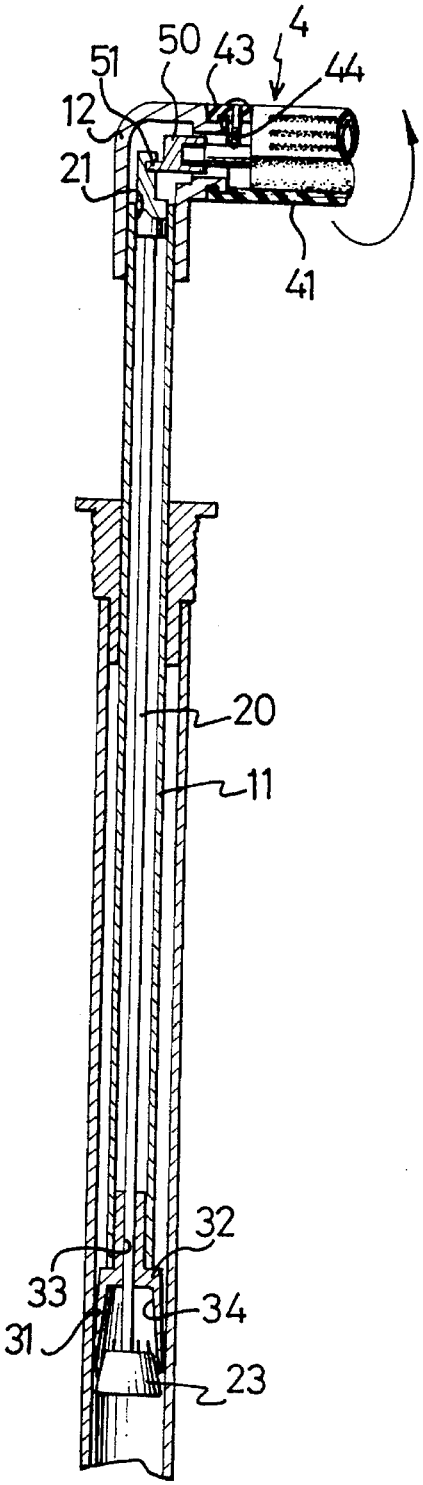
FIG. 3 is a cross-sectional view of the telescopic handle as shown in FIG. 1 in a first position.

Referring to FIG. 3, the link 20 is insertable through the first tube 11 and the tubular anchor 30 with the thread 25 disposed beyond the tubular anchor 30 and the head 21 disposed beyond the upper tip of the first tube 11. The thread 24 is engageable with the thread 25 for attaching the tubular plug 23 to the link 20. The first tube 11 and the tubular anchor 30 are receivable in the second tube 10.

The tubular plug 23 is disposed in a lower position so that the lower portion of the tubular anchor 30 is not in contact with the tubular plug 23 for allowing the first tube 11 and the tubular anchor 30 to slide in the second tube 10.

Figure 4:
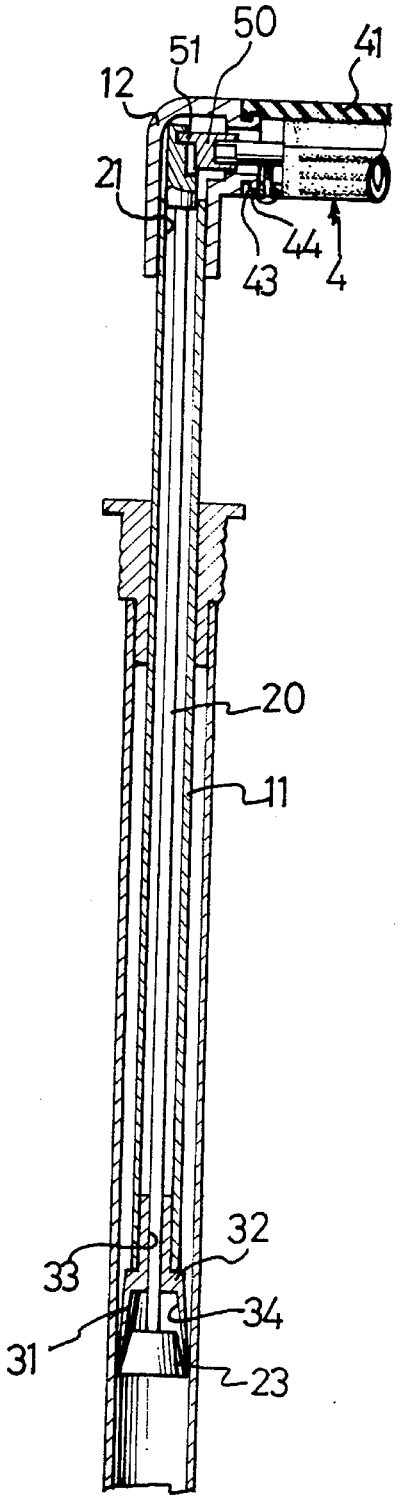
FIG. 4 is a cross-sectional view of the telescopic handle as shown in FIG. 1 in a second position.

Referring to FIG. 4, the tubular plug 23 is moved to an upper position so that the lower portion of the tubular anchor 30 is abutted against the second tube 10 by means of the tubular plug 23. Thus, the first tube 11 and the tubular anchor 30 are restrained with regard to the second tube 10.

The tubular anchor 30 can be moved to and retained in any position in the second tube 10, therefore, the length of the telescopic handle is freely adjustable.

Referring to FIG. 1 there are two angled tubes 12 each including a vertical tubular portion and a horizontal tubular portion. An annular flange 15 is formed on an external surface of the horizontal tubular portion of each of the angled tubes 12.

Figure 2:
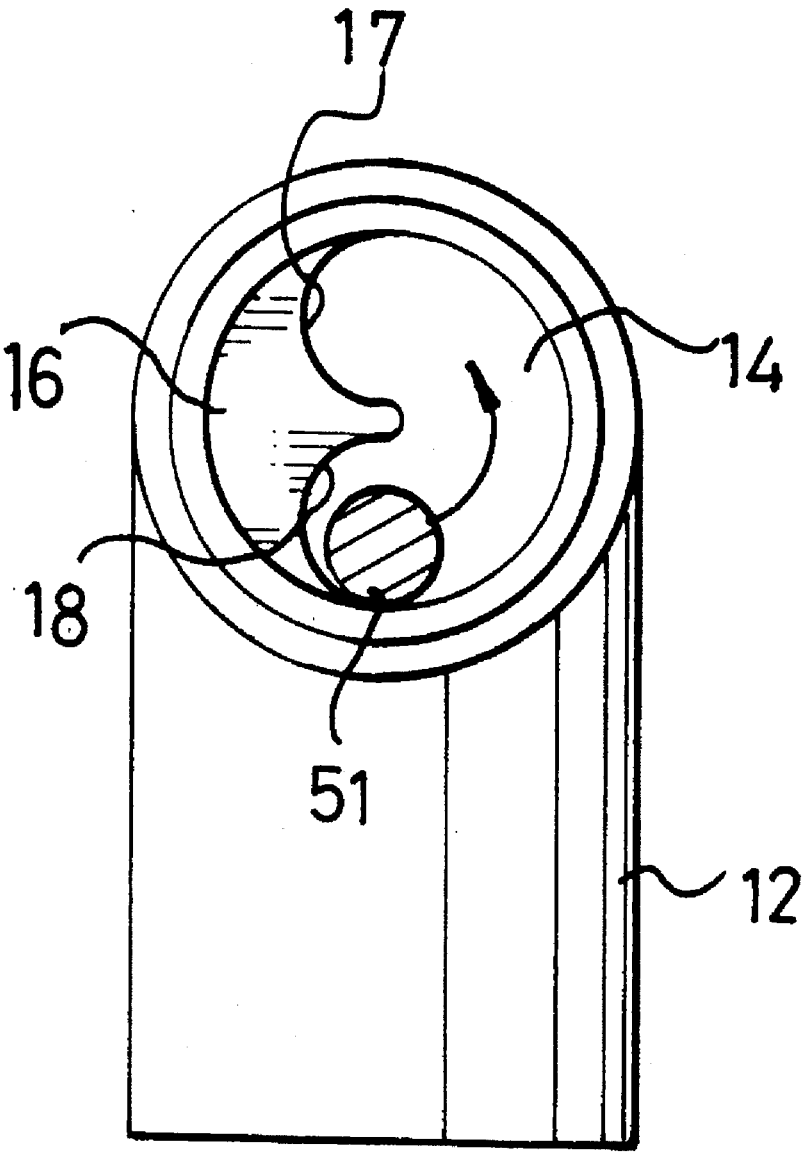
FIG. 2 is a cross-sectional view of an angled tube for linking a handle to a grip in the telescopic handle as shown in FIG. 1.

Referring to FIG. 2, a limit 16 is formed on an internal surface of the horizontal tubular portion of each of the angled tubes 12. The limit 16 defines two recesses 17 and 18.

Referring to FIG. 1, there are two couplers 50 each including a pin 51 projecting eccentrically from a first terminal portion and a groove 52 defined in a second terminal portion.

The grip 40 includes two tabs 42 each projecting from one of two terminal portions.

A first hemi-cylindrical shell 41 includes two grooves 45 each defined in one of two terminal portions.

There are two second hemi-cylindrical shells 43 each defining a groove 44 (see FIG. 3).

The upper tip of each of the first tubes 11 is secured in the vertical tubular portion of each of the angled tubes 12 by means of a screw (not shown) while each of the heads 21 is insertable in the vertical tubular portion of each of the angled tubes 12.

Each of the couplers 50 is receivable in the horizontal tubular portion of the tube 12 while the pin 51 of each of the couplers 50 is insertable past the limit 16 of one of the angled tubes 12 (see FIG. 2) into the recess 52 defined in one of the couplers 50.

Each of the tabs 42 is insertable in the groove 52 defined in one of the couplers 50.

The first hemi-cylindrical shell 41 is mounted on the horizontal portions of the angled tubes 12 with the annular flange 15 of each of the angled tubes 12 receivable in one of the grooves 45.

Each of the second hemi-cylindrical shells 43 is mounted on the horizontal tubular portion of each of the angled tubes 12 with the annular flange 15 of each of the angled tubes 12 receivable in the groove 44 defined in one of the second hemi-cylindrical shells 43.

Two screws 60 are each screwed into one of the second hemi-cylindrical shells 43, one of the tabs 42 and the first hemi-cylindrical shell 41 for securing the first hemi-cylindrical shell 41 and the second hemi-cylindrical shells 43 to the grip 40. The angled tubes 12 are connected with each other as the annular flange 15 of each of the angled tubes 12 is receivable in one of the grooves 45 defined in the first hemi-cylindrical shell 41 and the groove 44 defined in one of the second hemi-cylindrical shells 43. The grip 40 is pivotable relative to the angled tubes 12.

The above mentioned embodiment includes a grip 40 and two couplers 50. However, the grip 40 and the couplers 50 can be formed as an integral element.

The above mentioned embodiment includes two second hemi-cylindrical shells 43. However, the second hemi-cylindrical shells 43 can be replaced with a single element as the first hemi-cylindrical shell 41.

I claim:

1. A handle set comprising:

two telescopic handles, each including a telescopic handle with a freely adjustable length comprising a first tube, a second tube into which the first tube is telescopically insertable, a tubular anchor including an upper tip attached to a lower tip of the first tube and with a lower portion defining a plurality of slits so that the lower portion of the tubular anchor can be expanded easily, a link insertable through the first tube, a plug attached to a lower tip of the link, wherein by pulling the link the plug can be moved to an upper position for abutting the lower portion of the tubular anchor against the first tube for restraining the first tube relative to the second tube, wherein by pushing the link, the plug can be moved to a lower position for releasing the lower portion of the tubular anchor from the second tube for allowing the movement of the first tube in respect to the second tube;

two angled tubes each including a horizontal tubular portion and a vertical tubular portion in which the first tube of each of the telescopic handles is secured;

a grip connected between the horizontal tubular portions of the angled tubes; and two link-driving devices for driving the links.

2. A handle set according to claim 1 wherein the plug is a tubular element for receiving the link.

3. A handle set according to claim 2 wherein the link includes a thread formed thereon, wherein the plug includes a thread formed on an internal surface thereof.

4. A handle set according to claim 1 wherein the tubular anchor includes a neck axially projecting from the upper tip thereof.

5. A handle set according to claim 1 wherein the grip is pivotably connected between the horizontal tubular portions of the angled tubes, wherein each of the link-driving devices is connected between the grip and one of the links, so that the links are driven by means of the link-driving devices when the grip is pivoted.

6. A handle set according to claim 5 wherein each of the link-driving devices includes a recess defined in one of the links, a coupler including a pin projecting eccentrically therefrom and a groove defined therein and a tab projecting from each of two tips of the grip, wherein each of the tabs of the grip is receivable in the groove defined in one of the couplers while the pin of each of the couplers is receivable in the recess defined in one of links.

7. A handle set according to claim 5 wherein each of the link-driving devices includes a recess defined in one of the links and a pin projecting eccentrically from each of two tips of the grip wherein the pin projecting eccentrically from each of the tips of the grip is receivable in the recess defined in each of the links.

8. A handle set according to claim 5 including a first hemi-cylindrical shell attached to the grip and defining two grooves and two hemi-cylindrical shells each attached to one of two tips of the grip and defining a groove, wherein the horizontal tubular portion of each of the angled tubes includes an annular flange formed thereon, wherein the annular flange formed on each of the angled tubes is receivable in one of the grooves defined in the first hemi-cylindrical shell and the groove defined in each of the second hemi-cylindrical shells.

9. A handle set according to claim 8 including two screws for securing the first hemi-cylindrical shell and the second hemi-cylindrical shells to the grip.

10. A handle set according to claim 5 including two hemi-cylindrical shells attached to the grip and each including two grooves each defined near one of two tips thereof, wherein the horizontal tubular portion of each of the angled tubes includes an annular flange formed thereon, wherein the annular flanges formed on the angled tubes are receivable in the grooves defined in the hemi-cylindrical shells.

11. A handle set according to claim 10 including two screws for securing the hemi-cylindrical shells to the grip.

* * * * *